United States Patent [19]

Knorreck

[11] Patent Number: 4,932,385

[45] Date of Patent: Jun. 12, 1990

[54] FUEL INJECTION PUMP FOR INTERNAL COMBUSTION ENGINES

[75] Inventor: Peter Knorreck, Weissach, Fed. Rep. of Germany

[73] Assignee: Robert Bosch GmbH, Stuttgart, Fed. Rep. of Germany

[21] Appl. No.: 390,038

[22] Filed: Aug. 7, 1989

[30] Foreign Application Priority Data

Aug. 11, 1988 [DE] Fed. Rep. of Germany ..... 3827206

[51] Int. Cl.[5] ..... F02M 39/00

[52] U.S. Cl. ..... 123/502; 123/179 L

[58] Field of Search ..... 123/502, 179 L, 387, 123/449, 503

[56] References Cited

U.S. PATENT DOCUMENTS

| | | | |
|---|---|---|---|
| 4,430,974 | 2/1984 | Bofinger | 123/387 |
| 4,489,698 | 12/1984 | Hofer | 123/502 |
| 4,590,913 | 5/1986 | Faupel | 123/502 |
| 4,619,238 | 10/1986 | Hain | 123/502 |
| 4,622,943 | 11/1986 | Braun | 123/179 L |
| 4,733,645 | 3/1988 | Hain | 123/502 |
| 4,796,592 | 1/1989 | Hofer | 123/179 L |

FOREIGN PATENT DOCUMENTS

| | | | |
|---|---|---|---|
| 2099612 | 12/1982 | United Kingdom | 123/502 |

*Primary Examiner*—Carl Stuart Miller

*Attorney, Agent, or Firm*—Edwin E. Greigg

[57] ABSTRACT

A fuel injection pump for internal combustion engines, in which both a shift of the injection onset to early during cold starting or when the engine is not yet up to operating temperature can quickly become operative, and a fuel injection quantity adaptation device is operative unaffected by the control criteria for the cold-starting shift to early. To this end, a work chamber of an injection adjuster is acted upon separately by the feed pressure of a fuel feed pump prevailing upstream of a temperature-dependently unlockable pressure maintenance valve, and the pressure-controlled interior of a fuel injection pump supplying the adaptation device is connected to the outlet side of the pressure maintenance valve.

8 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines. In a fuel injection pump of this type, the controlled fuel pressure of the interior controls both an adjustment of injection onset, with a shift toward early for cold starting, and a fuel injection quantity adaptation device.

For adjusting the injection onset at cold starting, or when the engine is not yet up to operating temperature, an increased fuel pressure is needed, which is operative in the work chamber and acts on the adjusting piston, and which effects a different shift of the injection onset toward early from that effected by the control of injection onset when the engine is at operating temperature. To attain this pressure, in the known pressure control valve a pressure chamber communicates continuously via a throttle with a restoring chamber, which in turn communicates via a relief line with a relief chamber. The pressure maintenance valve is disposed in the relief line and while the engine is still cold maintains a high pressure, regardless of the control device, while when the engine is at operating temperature the pressure maintenance valve is kept open by the control device. (Alternatively, a bypass could be opened instead as a function of temperature.) The pressure equilibrium occurring at the movable wall of the pressure control valve when the engine is cold keeps this valve in its closing position in which it estabblishes the desired high pressure. At the same time, however, this pressure acts on a spring-loaded adaptation piston, or adaptation device. This makes for an incorrect control of the fuel injection quantity; to overcome it, the pressure prevailing in the restoring chamber is fed to the back end of the adaptation piston, so that the resultant force of the spring moves the adaptation piston into its normal position. This fails to take into account the rise in rpm during engine warmup or the resulting demand for fuel, however.

OBJECT AND SUMMARY OF THE INVENTION

The fuel injection pump according to the invention has an advantage over the prior art that the increased pressure initially needed for adjusting the injection onset when the engine is cold is not operative either in the interior nor on the adaptation device, yet nevertheless the pressure control valve feeds an rpm-dependent pressure into the interior by which the adaptation device is controllable, and errors in the maximal fuel metering are avoided.

DESCRIPTION OF THE PREFERRED EMBODIMENT

Figure 1:
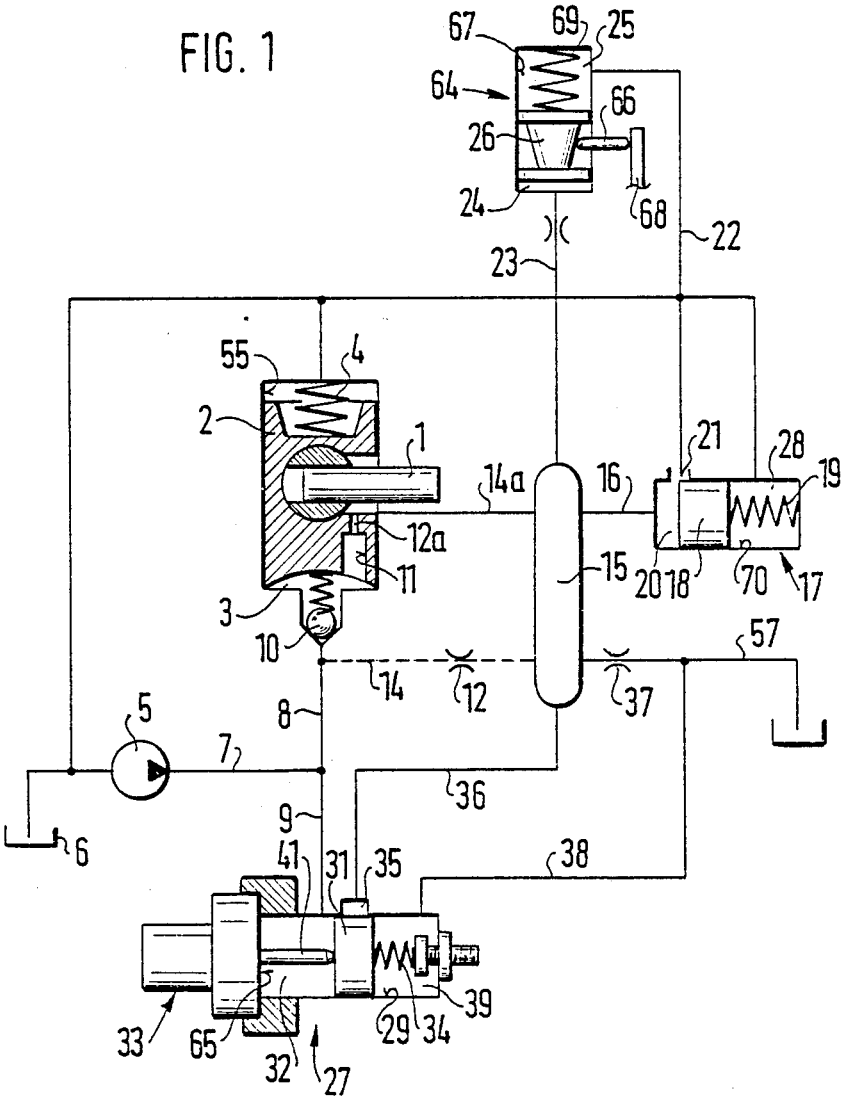
FIG. 1 is a schematic drawing of a fuel injection pump.

Via a pin 1, an adjusting piston 2 engages a cam drive of a known fuel injection pump, for adjusting the instant of injection onset. The adjusting piston 2 is displaceable, counter to the force of a restoring spring 4, in an injection adjusting cylinder 55, in which it functions as a movable wall to define a work chamber 3. Pressure fluid in the form of fuel located in the work chamber displaces the valve piston counter to the force of the restoring spring 4 with increasing fuel pressure, such that the farther the adjusting piston 2 is displaced toward the restoring spring 4, the more the instant of injection is shifted toward "early". The supply of fuel to the work chamber 3 is effected by a feed pump 5 that pumps as a function of rpm and is driven proportional to rpm; this pump aspirates fuel from a fuel tank 6 and feeds it into a feed pump pressure line 7. Branching off from the feed pump pressure line 7 is a pressure line 8, which contains an element that does not affect the flow, in the form of a one-way check valve 10, and discharges into the work chamber 3. In a variant feature, the work chamber communicates with the interior of the fuel injection pump represented by the element 15 via a bore 11 and an adjoining connection **14*a*, the bore being disposed parallel to the center axis of the work chamber in the adjusting piston and containing a throttle 12*a*. Leading away from the interior 15 of the fuel injection pump is a leakage line 57 provided with a throttle 37**.

The supply of fuel to the interior 15 of the fuel injection pump is effected from the feed pump pressure line 7 via a pressure line 9, which connects with a pressure maintenance valve 27. This valve has a cylinder 29, in which a pressure chamber 32, communicating with the pressure line, is defined by a face end 65 of a control device 33 and a piston 31 that is axially displaceable in the cylinder and serves as a valve closing member. The piston 31 is acted upon by a preferably adjustable restoring spring 34 disposed in a spring chamber 39. The piston controls a controllable diversion opening 35, which originates at the cylinder wall of the cylinder 29 of the pressure maintenance valve and defines a flow cross section for the fuel admitted via the pressure line 9. The diversion opening 35 communicates with the interior 15 of the fuel injection pump via a second line portion 36 of the pressure line. At the face end 65 of the cylinder 29 defining the other side of the pressure chamber 32 is the control device 33, in which the control is determined by the temperature of the internal combustion engine; the control device 33 has an actuating element 41, embodied as a pin or bolt, which protrudes axially into the pressure chamber 32 with one end in contact with the piston 31, the position of the bolt 41 corresponding to that in an operationally warm engine. As shown, the bolt 41 displaces the piston 31 so that it can open the diversion opening 35. With a cold engine, the piston 31 is displaced by the restoring spring 34 so far that the diversion opening 35 is closable by the piston, as shown in the drawing. This position corresponds to an engine that is still cold or is being started while cold. From the spring chamber 39, a leakage line 38 leads to the fuel supply container 6, or to the intake side of the feed pump.

In a second variant, the throttle **12*a*, the bore 11 and the connection 14*a* are replaced by a connecting line 14 containing a throttle 12 between the interior 15 of the fuel injection pump and the pressure line 8 upstream of the check valve 10, creating a bypass around the pressure maintenance valve 27. This bypass could instead be integrated in the pressure maintenance valve, in the form of either a throttle bore through the piston 31, or a throttle groove in the wall of the cylinder 29**.

For engine warmup, that is, the operating range between an engine that is still cold upon starting and when it attains operating temperature or the steady operating temperature, it is advantageous to attain a supplementary shift of the injection onset toward early as quickly as possible, if possible immediately upon starting. This shift to early is attained by introducing a pressure into the work chamber 3 that is higher than the pressure controlled in the interior 15 of the fuel injection pump by a pressure control valve 17.

The pressure control valve 17 has a piston 18 serving as a movable wall which is displaceable counter to the force of a control spring 19 in a cylinder 70, in which this piston 18 divides the cylinder 70 into a pressure chamber 20, that communicates with the interior 15 of the fuel injection pump via a line 16, from a restoring chamber 28, in which the control spring 19 is disposed. The piston 18 variably opens a diversion cross section 21 of an outflow opening in pressure chamber 20 to which a line 22 is connected that communicates with the intake side of the feed pump, the chamber 28 and to pressure chamber 24 of an adaptation device 64. The pressure control valve 17 controls the pressure in the interior 15 as a function of rpm, and substantially in proportion to rpm.

From the interior 15 of the fuel injection pump, a connecting line 23 leads into an adaptation pressure chamber 24 of an adaptation device 64, which has an adaptation piston 26 that is axially displaceable in an adaptation cylinder 67 counter to the force of a restoring spring 69. The cylinder 67 separates the adaptation pressure chamber 24 from a restoring chamber 25. The position of the adaptation piston 27, which is dependent on the pressure in the interior 15 of the fuel injection pump controlled by the pressure control valve 17, controls a fuel injection quantity device 68 via a scanner stylus 66.

If the engine is started while cold, or if the engine is still in the warmup range, then the actuating element 41 of control device 33 is in its retracted position, in which the diversion opening 35 at the pressure maintenance valve 27 is closed by the piston 31. Accordingly, the feed pump 5 feeds initially only via the feed pump pressure line 7, the pressure line 8 and the check valve 10 into the work chamber 3, so that with the full pumping capacity of the feed pump a high pressure is rapidly attained there, which in the first variant is affected only slightly by the fuel flowing out via the throttle **12*a* into the interior 15 of the fuel injection pump. The interior 15 of the fuel injection pump is supplied with fuel via the pressure maintenance valve 27, once its opening pressure is attained, and/or through the throttle 12 or 12*a*, and this fuel is kept by the pressure control valve 17 at an rpm-dependent pressure, regardless of any leakage losses via the throttle 37 or of the fuel withdrawn for fuel injection. As a function of this pressure, the adaptation device is already controlled as soon as the engine or fuel injection pump starts up. The injection onset, however, is already affected upon starting and is shifted to "early", as noted above. If the fuel supply to the interior 15 of fuel injection pump by the pressure maintenance valve in this operating phase is sufficient, the throttle 12 or 12*a*** may be omitted.

Figure 2:
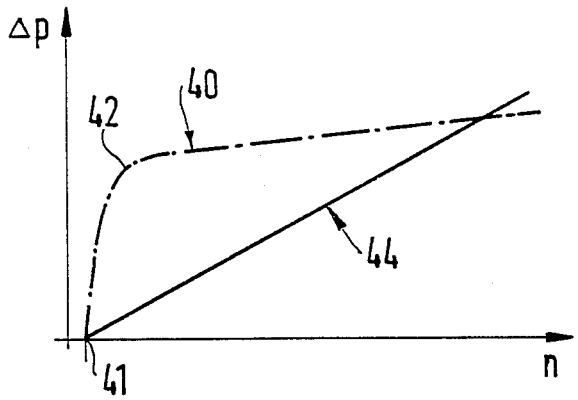
FIG. 2 is a diagram showing the courses of pressure over rpm in the fuel injection pump according to the invention.

FIG. 2 is a graph on which the rpm is plotted on the abscissa and the pressure prevailing in the work chamber 3 is plotted on the ordinate. A characteristic curve 40 between points 41 and 42 is evidence of a steep increase in the pressure at low rpm. Approximately at point 42, however, the opening pressure of the pressure maintenance valve 27 is attained, and the diversion opening 35 is opened by piston 31 due to an increase in pressure in chamber 32. As a result, the pressure in the work chamber 3 subsequently increases only negligibly with rising rpm. By comparison, the characteristic curve 44 is provided, which shows the course of the pressure in the interior 15 of the fuel injection pump controlled by the pressure control valve 17.

This pressure course as shown in FIG. 2 comes about as follows:

The pressure of the rpm-proportionally driven feed pump 5, which is applied to the piston 31 of the pressure maintenance valve 27, displaces the piston 31 counter to the force of the restoring spring 34 and opens the diversion opening 35 precisely far enough to maintain the maintenance pressure or opening pressure of the pressure maintenance valve toward the feed pump. Only a throttled flow into the interior 15 of the fuel injection pump occurs, and in it, with the aid of the pressure control valve 17, an rpm-dependent pressure can now be established in the fuel injection pump 15, by which the adaptation device 64 is actuated as a function of rpm. The fuel injection quantity control is thus not affected by the cold-starting shift of the injection onset to early, and a fast-acting cold-starting shift to early is attained.

The purpose fulfilled by the throttle 12 of the first variant is not only to assure that the interior 15 of the fuel injection pump is sufficiently supplied with fuel when the engine is cold, with certain designs of the pressure maintenance valve 27 and fuel feed pump with a late opening of the pressure maintenance valve 27, but also, together with the check valve 10 and in the presence of pulsed loads, to prevent the adjusting piston 2 from being substantially displaced by the pumping strokes of the pump piston, so that the instant of injection can be adhered to with sufficient precision.

The higher pressure in the work chamber 3 effecting the shift to early is reduced once the temperature control device 33 is triggered upon attainment of the operating temperature of the engine, and the actuating element 41, which is connected to an expandable element or bimetallic spring, moves the piston 31 counter to the force of the restoring spring 34 and thus opens the diversion opening 35. As a result, the interior 15 of the fuel injection pump communicates with the feed pump 5, and the pressure defined by the pressure control valve 17 in the interior 15 of the fuel injection pump becomes operative in the work chamber 3 as well, for controlling the injection onset.

The same control device 33 may be embodied as a temperature control device as well as an electromagnet controlled as a function of temperature. Instead of the temperature course over time, a timing element can also be used, which controls the actuating element 41 or a valve that fully opens an unthrottled bypass, in order to cancel the pressure maintenance function of the pressure maintenance valve.

If the engine is started when it is already at operating temperature, then the control device 33, by means of the actuating element 41, keeps the piston 31 in a position in which the diversion opening 36 is opened to the interior 15 of the fuel injection pump via the diversion line 36, and for adjusting the injection onset the pressure in the interior 15 of the fuel injection pump and in the work chamber 3 is varied as a function of rpm solely by the force of the control spring 19 and the piston 18.

Figure 3:
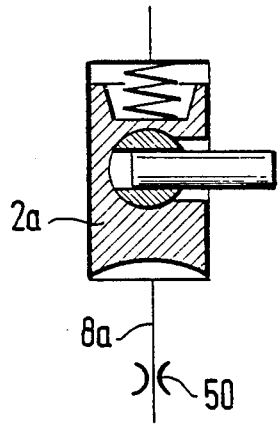
FIG. 3 shows an alternative version of a detail of the fuel injection pump of FIG. 1.

An alternative feature is shown in FIG. 3. With an otherwise identical design, modifications are made in the adjusting piston 2a and the pressure line 8a. In the pressure line 8a, instead of the check valve 10, a throttle 50 is provided, and in the control piston 2a the bore 11 and throttle 12 of FIG. 1 are omitted. The throttle 50 here performs the function of the throttle 12 of the preceding exemplary embodiment. It serves to supply fuel to the work chamber 3, and prevents mechanical forces upon the adjusting piston 2a from causing a displacement of the adjusting piston 2a.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for an internal combustion engine comprising, an injection adjusting cylinder (55) provided with an adjusting piston (2), said cylinder and said piston defining a work chamber (3), said adjusting piston (2) serving to adjust an injection onset and acted upon by a first restoring force (4) counter to said work chamber, a pressure line (8) leading from an output side of an rpm-dependently driven feed pump (5) to said work chamber (3), said fuel injection pump including an interior (15) supplied with fuel by the feed pump (5), a pressure control valve (17) which provides a rpm-dependent control of the fuel pressure in the interior of said fuel injection pump, said pressure control valve (17) including a piston (18) movable between a first pressure chamber (20) connected to said interior (15) of said fuel injection pump and a restoring chamber (28) counter to a second restoring force (19) in said restoring chamber, said piston (18) controlling a diversion cross section (21) to an output line (22), a pressure maintenance valve (27), a control piston (31) in said pressure maintenance valve (27), said pressure maintenance valve influencing the fuel pressure in a pressure chamber (32) that acts upon said control piston counter to a restoring spring (34), said control piston controlling a flow cross section (35) in an output of said pressure maintenance valve, the pressure maintenance function of said pressure maintenance valve being cancelable by a control device (33) as a function, of at least temperature, said fuel injection pump further having an adaptation device (64), controlled by the fuel pressure in the interior of said fuel injection pump, to provide rpm-dependent injection quantity adjustment, and said pressure line (8) containing a fuel control element (10, 50) which affects fuel flow to said work chamber (3) said pressure line (8) communicating directly with the outlet of the feed pump (5), and the interior (15) of said fuel injection pump and connectable to the feed pump (5) via said pressure maintenance valve (27).

2. A fuel injection pump as defined by claim 1, which includes a bypass line (14, 14a) which bypasses said pressure maintenance valve (27), and a throttle (12, 12a) provided in said bypass.

3. A fuel injection pump as defined by claim 2, in which said fuel control element that affects the fuel flow to said work chamber is a one-way check valve (10) opening toward the work chamber, and the throttle (12) is provided in the adjusting piston (2) between the work chamber (3) and the interior (15) of said fuel injection valve.

4. A fuel injection pump as defined by claim 1, in which said fuel control element that affects the fuel flow to said work chamber is a throttle (50) in said line (8).

5. A fuel injection pump as claim 1, in which said control device (33) has an actuating element (41) by which said control piston (31) is movable into an open position.

6. A fuel injection pump as claim 2, in which said control device (33) has an actuating element (41) by which said control piston (31) is movable into an open position.

7. A fuel injection pump as claim 3, in which said control device (33) has an actuating element (41) by which said control piston (31) is movable into an open position.

8. A fuel injection pump as claim 4, in which said control device (33) has an actuating element (41) by which said control piston (31) is movable into an open position.

* * * * *